United States Patent [19]

Zemanek

[11] 4,063,728

[45] Dec. 20, 1977

[54] CONVERTIBLE POOL TABLE GAME APPARATUS

[76] Inventor: Rudolf Zemanek, 516 S. Orlando Way, Vancouver, Wash. 98664

[21] Appl. No.: 641,288

[22] Filed: Dec. 16, 1975

[51] Int. Cl.[2] ..... A63D 15/04

[52] U.S. Cl. ..... 273/4 R; 273/3 A; 273/5 A; 273/9; 273/14; 273/7

[58] Field of Search ..... 273/4 R, 4 B, 4 C, 5 A, 273/14, 126 R, 126 A, 127 R, 127 C, 127 B, 85 R, 85 A, 85 B, 85 C, 85 D, 85 F, 2, 7, 3 A, 8, 118 D

[56] References Cited

U.S. PATENT DOCUMENTS

| | | | |
|---|---|---|---|
| 483,109 | 9/1892 | Green | 273/118 D |
| 908,752 | 1/1909 | Cornwall | 273/4 B |
| 1,049,948 | 1/1913 | Water | 273/4 B |
| 1,157,940 | 10/1915 | Hjorth | 273/4 B |
| 3,228,688 | 1/1966 | Dennison | 273/85 R |
| 3,489,409 | 1/1970 | Porath | 273/5 A |
| 3,889,945 | 6/1975 | Ellis | 273/8 |

FOREIGN PATENT DOCUMENTS

| | | | |
|---|---|---|---|
| 744,276 | 10/1966 | Canada | 273/8 |
| 631,100 | 9/1927 | France | 273/8 |

*Primary Examiner*—William H. Grieb
*Assistant Examiner*—T. Brown
*Attorney, Agent, or Firm*—Lawrence E. Laubscher

[57] ABSTRACT

A billiard game and apparatus are disclosed for playing a simulated game of hockey, soccer, lacrosse, or the like, characterized by the provision of a horizontal planar playing surface bearing indicia representing the playing field of the game to be played, together with side boards arranged at the periphery of the planar surface for defining an enclosed playing area, and goals for receiving one of a number of billiard-type balls resting on the planar surface. The planar surface comprises the playing surface of a standard pool table upon which is removably laid a cover of cloth or the like which is held in place by the side boards which are removably mounted on the pool table adjacent the side rails thereof. The side boards means consist of linear side and end sections, and curved corner sections, the sections being of sufficient width to cover the pockets of the pool table. Attached to each of the end sections of the side boards are goals including a goal member supported by a support member. Visual and/or audible indicating devices may be provided for indicating the entry of a ball into either of the goals.

6 Claims, 4 Drawing Figures

CONVERTIBLE POOL TABLE GAME APPARATUS

BRIEF DESCRIPTION OF THE PRIOR ART

Various types of game apparatus are disclosed in the patented prior art, as evidenced, for example, by the patents to Fountain U.S. Pat. No. 615,350 and Luchsinger U.S. Pat. No. 3,214,171.

The Fountain game apparatus relates to a convertible game table including a removable rigid rectangular frame which fits within the cushions of a pool table for converting the pool table to a billiard table, the rectangular frame being designed to cover the pockets of the pool table. Luchsinger discloses a magnetic hockey game apparatus in which a hockey rink is provided with goals and enclosing side walls. A single magnetic playing piece simulates a hockey puck and is projected toward the goals by impelling members.

SUMMARY OF THE INVENTION

The present invention relates to improved game apparatus of the billiard ball and table type for playing simulated games of hockey, soccer, lacrosse or the like.

In one embodiment adapted for use on a standard pool table, the game apparatus includes a cover member, preferably formed of cloth, bearing indicia resembling the playing surface of a given game, said cover member being adapted to be laid on the playing surface of the pool table. Side board means are fitted against the inner surfaces of the side rails of the pool table to cover the conventional billiard ball pockets, the side board means being sectional and including rounded corner portions. Goal means are provided at each end of the game apparatus for receiving one of a plurality of balls that are placed upon the playing surface.

In a second embodiment, the game apparatus includes a unitary game table provided with side board means, the goal means including openings contained in the playing surface. As an added feature, a plurality of billiard balls are provided at least one of which differs in size from the others, the goal means being responsive only to the smaller sized ball, thereby allowing for a greater element of skill and excitement in the playing of a game.

Accordingly, a primary object of the present invention is to provide an improved game apparatus including a horizontal planar surface, a cover mounted on the planar surface for supporting a plurality of billiard-type balls, said cover bearing indicia simulating the playing area of a given game, sectional side board means mounted on the planar cover surface to define a completely enclosed playing area, and goal means at opposite ends of the apparatus for receiving at least one of the balls.

According to a more specific object of the invention, the game apparatus is adapted for mounting upon the playing surface of a standard pool table to convert the pool table into a simulated hockey rink, soccer field, or the like.

According to another object of the invention, the game apparatus comprises a unitary table having a horizontal upper surface which constitutes the planar playing surface, and goal means defined by a pair of openings contained in the horizontal surface, ball return passages being also provided in the table.

A further object of the present invention is the provision of a game apparatus which consists of a plurality of components that are readily assembled and disassembled.

A still further object of the invention is the provision of a game apparatus which affords the playing of games that are exciting, skillful, and interesting to play.

BRIEF DESCRIPTION OF THE FIGURES

Other objects and advantages of the present invention will become apparent from a study of the following specification when viewed in light of the accompanying drawings, in which.

DETAILED DESCRIPTION

Figure 1:
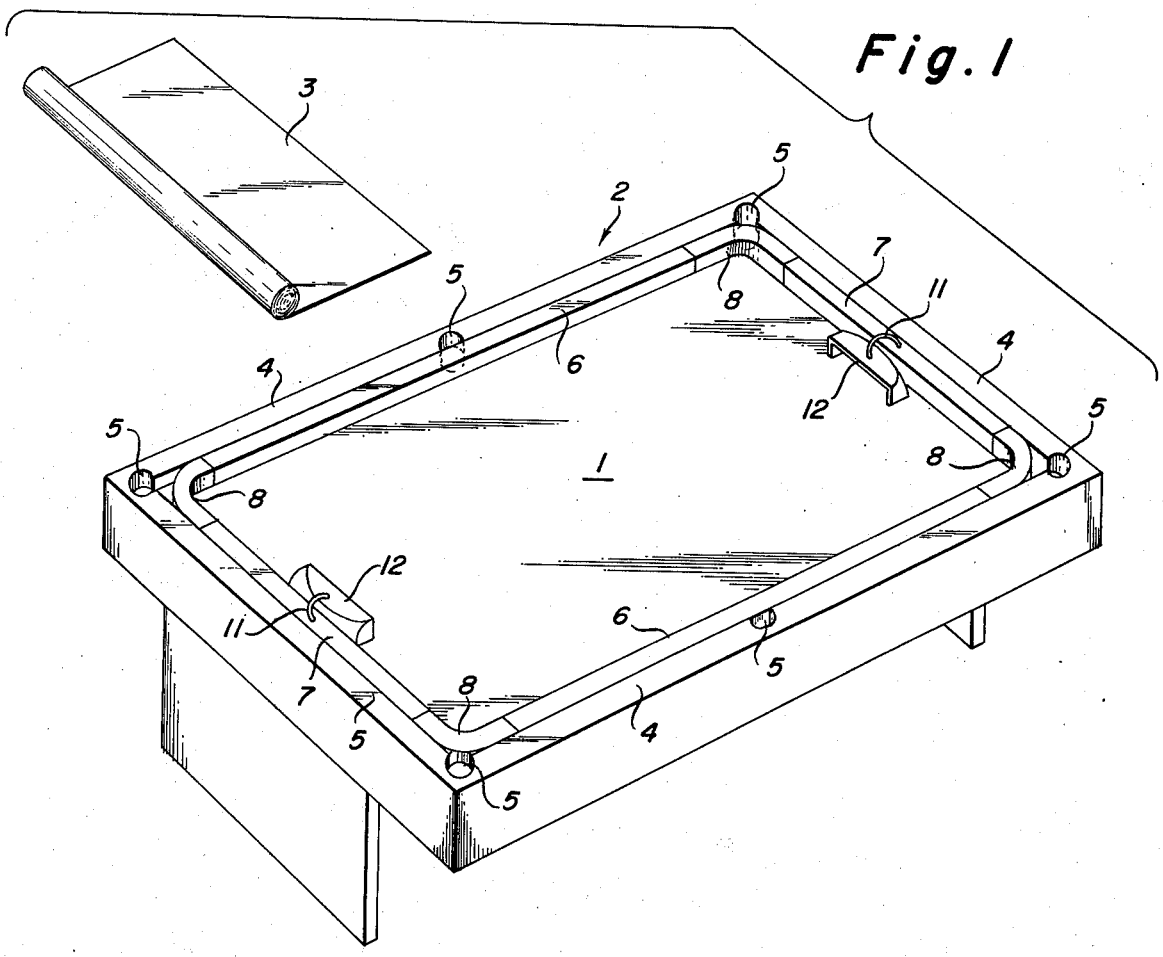
FIG. 1 is a perspective view of the first embodiment of the invention with the cover member removed.
Figure 4:
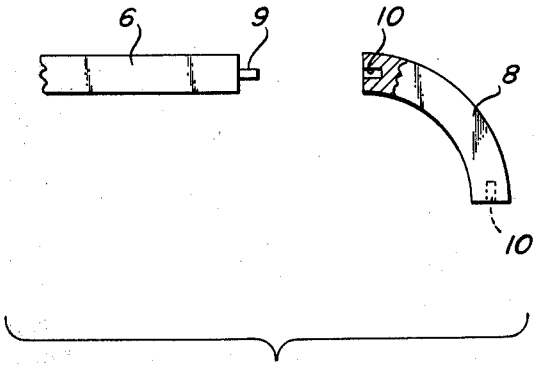
FIG. 4 is a detailed view of the connecting means for the side board sections of FIG. 1.

Referring first more particularly to FIG. 1, there is shown a planar surface 1 which comprises the playing surface of a standard pool table 2. Adapted to be removably supported upon the planar surface is a flexible cover member 3 — formed of cloth, for example — bearing indicia simulating the playing area of a given name, such as hockey or soccer. The standard pool table 2 has side rails 4 and pockets 5. Mounted on the peripheral portion of the cover member 3 against the side rails 4 of the standard pool table are the sectional side board means of the game apparatus. The side board means include linear side and end wall sections 6 and 7, respectively, and curved corner sections 8. The side board sections 6, 7 and 8 are connected in any suitable manner, as, for example, by a dowel pin and bore connection. One such method is illustrated in FIG. 4, wherein dowel pin 9 extends from the end of the side wall section 6 for insertion into a corresponding bore 10 contained in the end of the curved corner section 8. Various methods may be used to secure the goals to the playing surface. In FIG. 1, resilient goal support means 11 are connected with each of the end wall sections 7 of the side board means for supporting a goal 12 containing an opening of given size relative to the billiard-type balls which are used with the apparatus.

In order to use the game apparatus with a standard pool table, the cover member 3 is unrolled and laid flat upon the planar surface 1 of the pool table, whereupon the corner, end and side sections of the side board means are assembled to define a rigid assembly that is deposited upon the cloth member to define a completely enclosed playing area. The side board means have a width to cover the conventional pool pockets 5 contained in the pool table. The playing balls are then deposited upon the playing surface, each of said balls being formed of a material corresponding to that of a conventional billiard ball. If desired, at least some of the balls may have different sizes, the smaller balls being of a size corresponding with the size of the goal opening. Depending on the rules adopted for playing the game, the balls are played by a conventional billiard cue to shoot the smaller ball (or balls) into selected goals at opposite ends of the playing area.

In one preferred game to be played with the game apparatus, once the game apparatus has been assembled, play of the soccer or hockey game may begin. Each player has six player balls of the same size, and the object of the game is to score a greater number of goals. Play begins with a designated player striking one of his player balls with a cue so that it knocks the puck ball away from the goal which he is defending and toward the goal in which he may score. Play continues under the same basic rules as either hockey or soccer, with penalties and penalty shots provided for as in the regulation games. Play is ended either when a designated number of goals has been scored by one team or when a designated time period is up.

Figure 2:
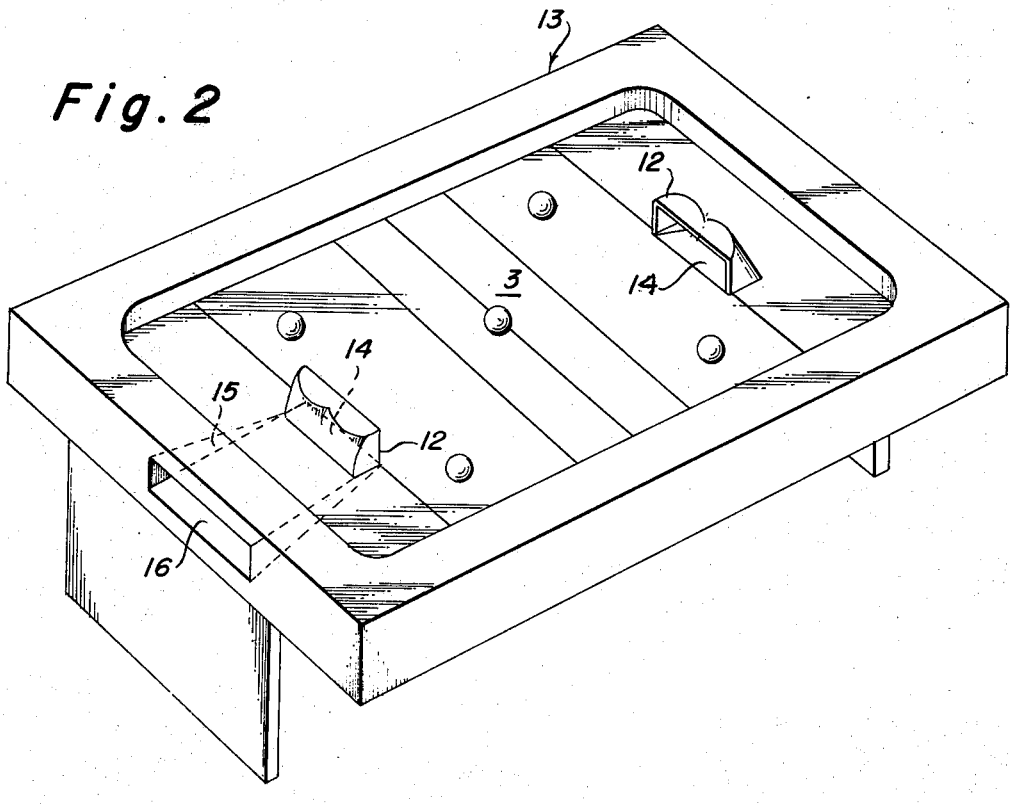
FIG. 2 is a perspective view of the second embodiment of the invention with the cover member in place.

A second embodiment of the invention is illustrated in FIG. 2. A table 13 has permanently mounted on its upper horizontal surface a cloth cover member 3 and side boards which completely enclose the playing area. Goal members 12 secured to the table partially surround openings 14 contained in the upper horizontal surface and in the cover. Descending from each of the openings 14 is a ball return chute 15 which connects the openings with the ball retrieving opening 16 contained in the side of the table. The goal member 12 is secured to the table in any suitable fashion, such as, for example, with screws which pass through holes in the upper horizontal surface and into the post portions of the goal member.

Figure 3:
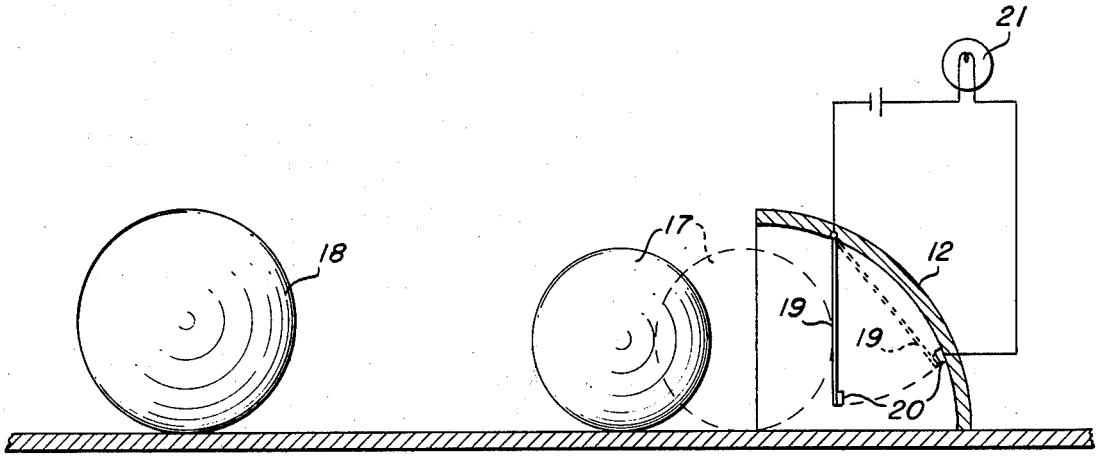
FIG. 3 is a detailed view of the goal means of the embodiment of FIG. 1.

In accordance with another important feature of the invention, visual or audible indicating means may be provided with either embodiment for indicating when a ball has been shot into a goal. Referring now to FIG. 3, it will be seen that one of the pool balls 17 is of a smaller diameter than the remaining pool balls 18. The smaller pool ball 17 is designated as the puck ball and the larger pool balls 18 are designated as the player balls. When the puck ball 17 enters the goal, it contacts the impeller member 19 and causes it to pivot rearwardly. When the impeller member reaches its uppermost, the electrical contacts 20 close to complete an electrical circuit, thereby to energize the indicator means (such as the light 21).

While in accordance with the provisions of the Patent Statutes the preferred forms and embodiments of the invention have been illustrated and described, it will be apparent to those skilled in the art that various changes and modifications may be made without deviating from the inventive concepts set forth above.

What is claimed is:

1. Game apparatus for use in connection with a pool table having a horizontal planar playing surface for supporting a plurality of billiard-type balls, and side rails arranged about the edge of said playing surface, comprising:

a. a cover member removably mounted on said playing surface, said cover member bearing indicia corresponding to a given game to be played with the apparatus;

b. side board means removably seated upon the peripheral edge portions of said cover member for retaining said cover member on said planar surface, said side board means including opposed pairs of linear side and end wall portions; and c. means defining a pair of goal means adjacent each of said end wall portions, respectively, each of said goal means including a goal member containing an opening the size of which corresponds with the diameter of at least one ball, and resilient means supporting said goal member inwardly from the corresponding end wall portion.

2. Apparatus as defined in claim 1, wherein said side board means is sectional and includes a plurality of side wall, end wall and curved corner sections, and means connecting said sections together.

3. Apparatus as defined in claim 1, wherein said side board means is so dimensioned as to abut against the side rails of the standard pool table, said side board means having a sufficient width to cover the pockets contained in the pool table.

4. Apparatus as defined in claim 1, and further including ball-responsive indicating means associated with each of said goal members, respectively, each of said indicating means being operable from a de-activated to an activated condition when said one ball enters said goal member.

5. Apparatus as defined in claim 1, and further including a plurality of billiard-type balls, one of said balls having a diameter which corresponds to the size of the goal opening, and at least some of the remaining balls having a greater diameter than said one ball.

6. Apparatus as defined in claim 1, wherein said cover member is formed of cloth.

* * * * *